United States Patent [19]

Eckholt

[11] 4,193,372

[45] Mar. 18, 1980

[54] APPARATUS FOR WAXING A YARN

[75] Inventor: Heinrich Eckholt, Münster, Fed. Rep. of Germany

[73] Assignee: Hamel GmbH Zwirnmaschinen, Münster, Fed. Rep. of Germany

[21] Appl. No.: 878,885

[22] Filed: Feb. 17, 1978

[30] Foreign Application Priority Data

Feb. 18, 1977 [DE] Fed. Rep. of Germany ..... 2707044

[51] Int. Cl.[2] ..... D06M 13/02; B05C 1/06

[52] U.S. Cl. ..... 118/713; 118/75; 118/78; 118/243

[58] Field of Search ..... 118/76–78, 118/9, 211, 243, DIG. 20, DIG. 21, DIG. 22; 427/11, 117, 111, 175, 178, 434 D; 156/230, 237, 241; 242/18 R

[56] References Cited

U.S. PATENT DOCUMENTS

| | | | |
|---|---|---|---|
| 493,524 | 3/1893 | Sabold | 118/243 X |
| 527,009 | 10/1894 | Bazerque | 118/243 |
| 2,304,564 | 12/1942 | Gladding | 118/243 X |
| 2,548,856 | 4/1951 | Bauer | 118/234 |
| 2,636,472 | 4/1953 | Vargo et al. | 118/263 X |
| 2,781,021 | 2/1957 | Schmitz | 118/235 X |
| 3,136,659 | 6/1964 | Walker et al. | 118/243 X |
| 3,173,806 | 3/1965 | Dodge | 118/243 X |
| 3,688,735 | 9/1972 | Brenner | 118/243 X |

*Primary Examiner*—Morris Kaplan
*Attorney, Agent, or Firm*—Karl F. Ross

[57] ABSTRACT

A yarn is waxed as it passes from a rotating takeup gripper to the traversing eye of a driven takeup spool. Toward this end the yarn is passed tangentially over and deflected by a waxing bar that is reciprocated transversely to the direction of the travel of the yarn. Spaced from the path of the yarn is a wax body that is pressed against the surface of the bar which is reciprocated through a sufficiently long path that wax applied to the bar at the body is displaced along and transferred to the yarn.

13 Claims, 2 Drawing Figures

APPARATUS FOR WAXING A YARN

FIELD OF THE INVENTION

The present invention relates to an apparatus for waxing yarn. More particularly, this invention concerns a waxing system usable in conjunction with a yarn twister.

BACKGROUND OF THE INVENTION

It is frequently desirable after twisting one or more yarns to apply a coating of wax or paraffin to such a yarn. This can be done in several ways such as, for instance, shown in German patent publications 1,292,566, 2,105,588, and 2,226,311 (U.S. Pat. No. 2,890,924) by passing the yarn directly over a body of wax or paraffin. Typically a rotating paraffin body is positioned in the path of the yarn downstream of the twister, and means is provided for advancing the body toward the yarn as it is used up.

Such arrangements have two considerable disadvantages. First of all relatively complex drive and feed systems are necessary for the paraffin body. Second, the yarn must be relatively tightly spanned or stretched over such a body in order to ensure good wax transferal from the body to the yarn. Such tight tensioning of the yarn is disadvantageous in many systems wherein the yarn is relatively bulky and weak, or where it is subsequently taken up in a relatively loose yarn package.

OBJECTS OF THE INVENTION

It is therefore an object of the present invention to provide an improved apparatus for waxing a yarn.

Another object is to provide such an apparatus surely and efficiently applies an even coating of wax to a yarn without any of the above-mentioned disadvantages of the known systems.

A further object is the provision of such a system which is relatively simple and which can be applied to a multiple yarn feeding or twisting machine.

SUMMARY OF THE INVENTION

These objects are attained according to the present invention in a system where the yarn is conducted along a yarn path from an upstream feed location through a treatment location to a downstream feed location. A region of a surface of a bar or the like is periodically displaced between a waxing station spaced from the path and this treatment location. Wax is applied to this surface at the waxing station and the yarn is contacted with this surface at the treatment location. Thus, wax which has been applied to the surface at the waxing station is transferred to the yarn at the treatment station.

With this arrangement the surface acts merely as a carrier for the wax and the supply of wax on the surface is periodically or continuously renewed. Thus once appropriately positioned it is not necessary to periodically reposition the wax-carrying surface toward the yarn as in the prior-art systems. Furthermore the surface can be so chosen that the wax is transferred relatively easily from it to the yarn, normally by constituting this surface as a flat facet of a polygonal-section steel tube or bar.

When used in a multiple yarn-twisting machine the surface can be formed as a single bar extending past all of the twisters adjacent the respective takeup spools thereof. Midway between each pair of adjoining treatment locations there is provided a single wax supply, normally in the form of a holder containing a body of wax and means urging this body of wax into contact with the surface of the bar. The bar need merely be stroked through a sufficient distance to ensure contacting of the entire working surface of the bar with the wax body during each stroke. Normally the stroke of the bar is adjusted to be approximately or at least equal to the spacing along the bar between adjacent treatment locations.

In accordance with yet another feature of this invention there is provided immediately downstream in the travel path of the yarn from each of the treatment locations a traversing yarn guide of the type that ensures that the yarn is wound uniformly over a spool or core. The reciprocation rate, that is complete strokes per unit time, of the bar is substantially less in this arrangement than the reciprocation rate of the traversing guide, so that an excellent contacting and rolling of the yarn over the surface of the bar is obtained.

Such an arrangement works very well even with relatively low thread tension. Furthermore the threading of a standard twisting machine so equipped is not rendered any more complex by the provision of the waxing arrangement. Stopping the reciprocation of the waxing bar and/or pulling it out of contact with the yarn eliminates the waxing function altogether. In addition the provision of this waxing arrangement downstream in the yarn feed path from the main yarn takeup spool or device ensures that this latter unit will not have to be adjusted when the yarn is being waxed, as in the prior art devices where such waxing occurs downstream and the yarn takeup device has to be tightened to compensate for the change in surface friction.

SPECIFIC DESCRIPTION

Figure 1:
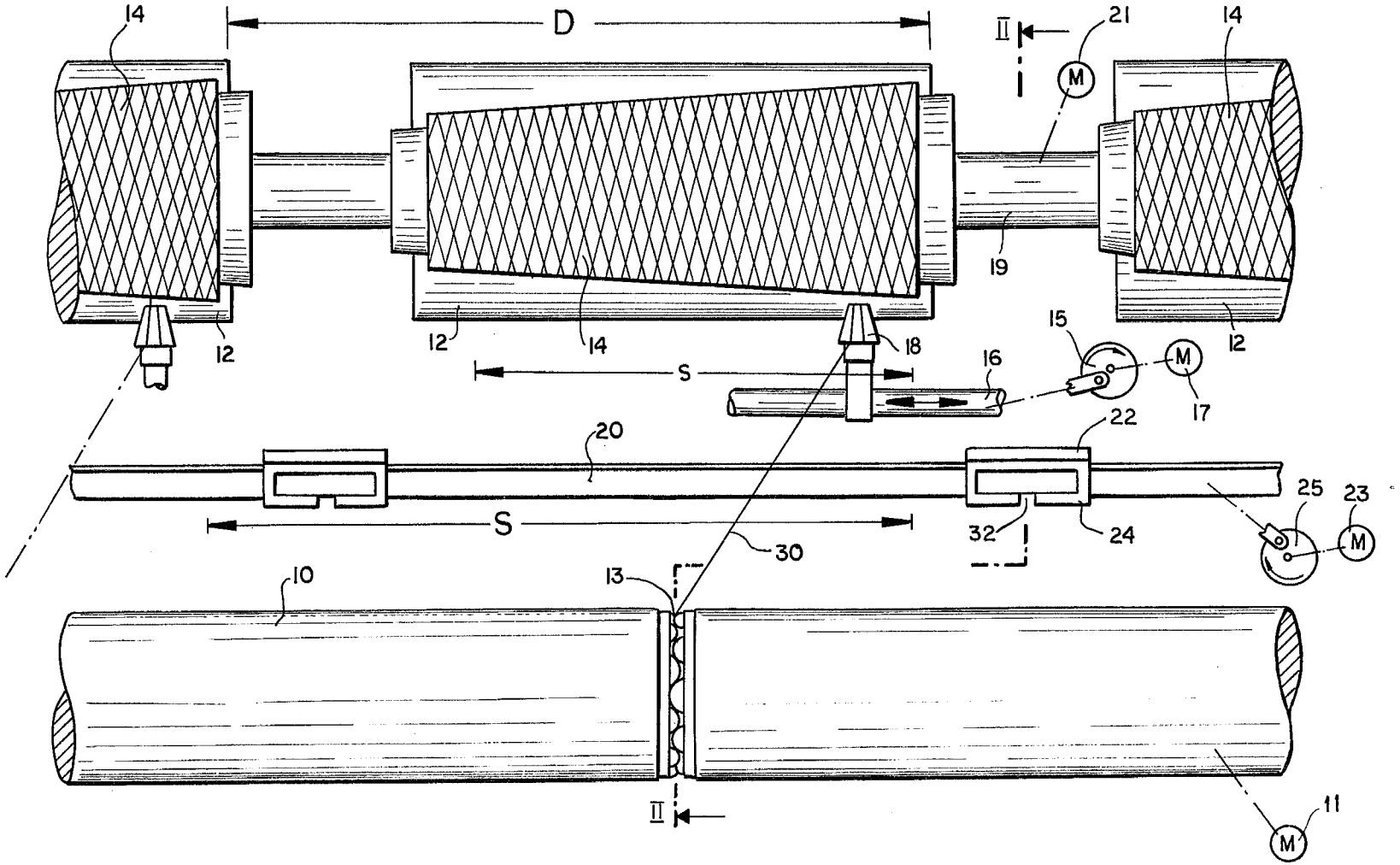
FIG. 1 is a partly diagrammatic sideview showing the system according to this invention.

FIG. 1 shows a yarn takeup device 10 driven by a motor 11 and having a plurality of yarn grippers 13 only one of which is shown in FIG. 1. Each gripper 13 pulls a yarn 30 from a double-twist spindle and feeds it through a traversing eye 18 carried on a shaft 16 reciprocated by means of a crank arrangement 15 driven by a motor 17 to a takeup spool 14 driven by a takeup roller 12 carried on a shaft 19 and rotated continuously by a motor 21. The motors 11, 17, and 21 can all be operated synchronously so as to advance the yarn 30 at a predetermined speed while the traversing eye 18 is reciprocated at a predetermined rate through a predetermined stroke distance s to lay the yarn 30 evenly on the spool 14 that is frictionally driven by the respective drum 12.

Figure 2:
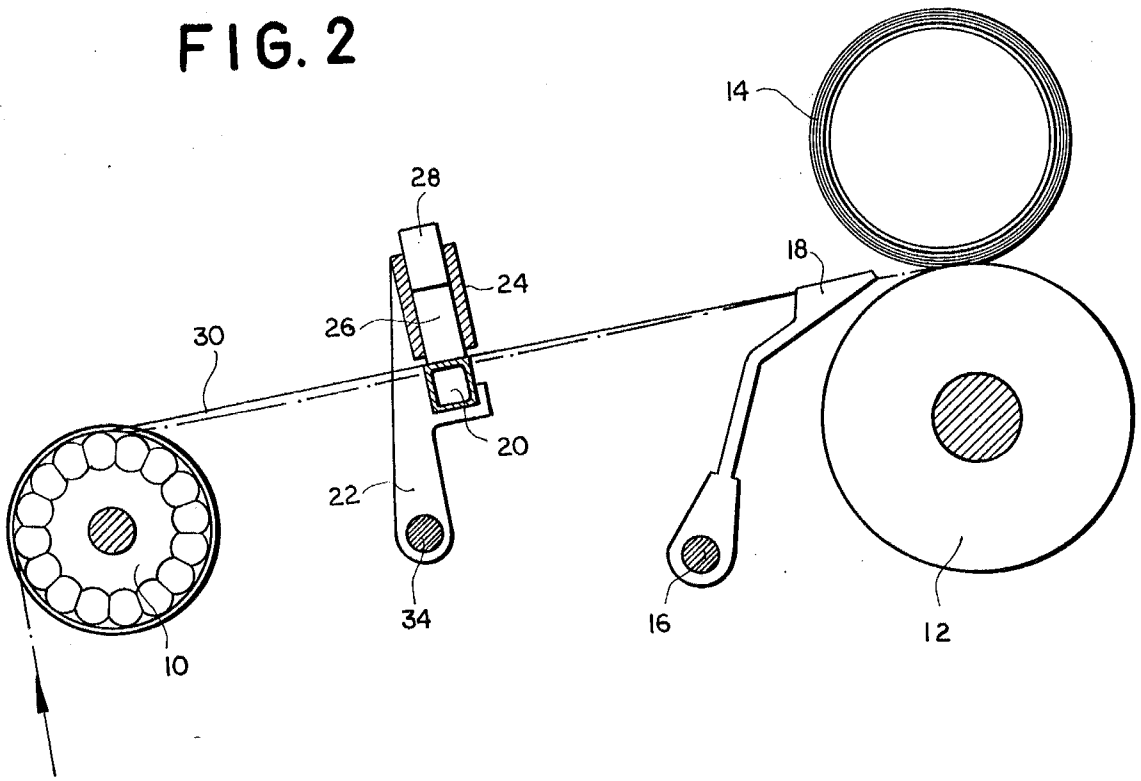
FIG. 2 is a section taken along line II—II of FIG. 1.

Between each upstream takeup gripper 10 and the respective downstream guide eye 18 the yarn is passed over one facet of a square-section tubular bar 20 positioned so that the yarn is deflected from what normally would be a straight path as shown by dot-dash lines in FIG. 2 to a path with two straight sections not aligned with each other. This bar 20 is supported on a plurality of arms 22 all carried on a common rod 34 defining an axis parallel to the rotation axes of the shafts 10 and 19. Each arm 22 further carries a holder 24 in which is vertically slidable a block 26 of wax. A weight 28 bearing on the top of each such block 26 urges it into engagement with the upper flat face of the bar. The holder 24 is made partially of a transparent material and is formed with a slot 32 so that the height of the block 26 can be ascertained from outside.

A motor 23 connected to a crank arrangement 25 reciprocates the bar 20 along its axis through a stroke S which is substantially equal to this spacing D between adjacent like regions on adjacent takeup spools and waxing assemblies. The arms 22 are provided midway between the centers of adjacent takeup drive rollers 12 and grippers 10, that is at this spacing D. Thus as the bar 20 is reciprocated the wax body 26 which is urged against it by the weight 28 will form a thin wax layer on the upper surface of this bar 20. As the yarn 30 rubs over the bar the wax will be transferred to this yarn, whereupon the yarn will be wound up on the spool 14. The relatively long length S of the stroke of the rod ensures that the entire surface of this element will be swept by the filament 30, preventing build-ups of wax and ensuring most even application of the wax. Furthermore the reciprocation rate of the bar 20 is a fraction that of the traversing eye 18 so that the yarn 30 is effectively rolled over the surface of the bar 20 and even better application of the wax is ensured. In case no waxing is desired all that is necessary is to stop the motor 23, whereupon in very short order the wax will be wiped off the upper surface of the bar 20 completely. It is also possible, of course, to displace the rod 34 downwardly or to pivot the arms 22 to take the bar 20 out of contact with the yarn 30. Pivoting of the arms 22, and therefore, of the bar 20 about the axis defined by the rod 34 can also be used to vary the contact area between the yarn 30 and the upper flat surface of the bar 20. If the bar is fixed so that only a corner of it engages the yarn 30 the amount of wax transferred will be considerably less, however, normally maximum wax transfer is desired so that the flat engagement of the yarn 30 against the flat facet of the bar 20 is desired.

It is also within the scope of this invention to provide the waxing bar 20 upstream of the gripper 10 so that the filament 30 always runs at a direct right angle to the bar 20. Such an arrangement necessitates a greater contact angle between the filament 30 and the gripper 10, as the waxed filament has a lower coefficient of friction. Nonetheless such an arrangement does achieve perfectly uniform waxing due to the constant angle of engagement.

I claim:

1. An apparatus for waxing a yarn, said apparatus comprising:

means for feeding said yarn along a yarn path between an upstream feed location and a downstream feed location and through a treatment location between said feed locations;

an elongated and substantially continuous surface extending through and having a first portion at said treatment location and having spaced from said treatment location and at a waxing station a second portion contiguous with said first portion;

means for pressing a body of wax against said portions in said waxing station; and means for periodically reciprocating said portions between said waxing station and said treatment location with said yarn in continuous engagement with said surface and for transferring the wax applied in said station to said portions to said yarn in said treatment location.

2. The apparatus defined in claim 1 wherein said surface is formed by an elongated bar extending through said treatment location and through said waxing station.

3. The apparatus defined in claim 1, further comprising a second such means for feeding and a second such means for applying, said treatment locations and waxing stations being spaced apart by approximately the same distance, said surface extending through both of said treatment locations, said means for displacing being effective for reciprocating said surface through strokes of a stroke length greater than said distance.

4. The apparatus defined in claim 3 wherein each of said means for feeding includes a respective means for winding the respective yarn up on a respective spool and a respective traversing eye displaceable through a predetermined traversing stroke shorter than said stroke length of said surface.

5. The apparatus defined in claim 4 wherein each of said means for feeding includes a yarn twister upstream of said upstream location.

6. The apparatus defined in claim 1, further comprising means for displacing said surface out of said path and out of contact with said yarn.

7. The apparatus defined in claim 1, wherein said surface is substantially planar, said apparatus further comprising means for varying the angle between said surface and said path.

8. The apparatus defined in claim 7 wherein said surface extends generally perpendicular to said path.

9. An apparatus for waxing a yarn, said apparatus comprising:

means for feeding said yarn along a yarn path between an upstream feed location and a downstream feed location and through a treatment location between said feed locations;

an elongated bar extending through said treatment location and through a waxing station and having a surface displaceable between a position at said treatment location and a position spaced from said treatment location and at said waxing station;

means for applying wax to said surface in said waxing station; and means for periodically longitudinally reciprocating said surface between said waxing station and said treatment location and transferring the wax applied in said station to said surface to said yarn in said treatment location.

10. The apparatus defined in claim 9 wherein said means for applying includes a holder fixed at said station and containing a body of said wax, and means for urging said body in said holder against said surface.

11. The apparatus defined in claim 10 wherein said means for urging includes a weight bearing downwardly on said body.

12. The apparatus defined in claim 10, further comprising a window slot formed in said holder for viewing of said body of wax through said slot.

13. The apparatus defined in claim 10 wherein said holder is at least partially transparent for viewing of said body of wax.

* * * * *